US006918546B2

(12) United States Patent
Leisi

(10) Patent No.: US 6,918,546 B2
(45) Date of Patent: Jul. 19, 2005

(54) REVERSIBLE SPRAY HEAD

(75) Inventor: Marcel Leisi, Nyon (CH)

(73) Assignee: Exit SA (CH)

( * ) Notice: Subject to any disclaimer, the term of this patent is extended or adjusted under 35 U.S.C. 154(b) by 0 days.

(21) Appl. No.: 10/757,845

(22) Filed: Jan. 15, 2004

(65) Prior Publication Data

US 2004/0195354 A1 Oct. 7, 2004

(30) Foreign Application Priority Data

Jan. 17, 2003 (CH) ..... 0071/03

(51) Int. Cl.[7] ..... F23D 14/50

(52) U.S. Cl. ..... 239/119; 239/119; 239/288; 239/288.3; 239/288.5; 239/290

(58) Field of Search ..... 239/119, 288, 239/288.3, 288.5, 290–296, 104

(56) References Cited

U.S. PATENT DOCUMENTS 3,112,885 A * 12/1963 Bell et al. ..... 239/394
3,116,882 A * 1/1964 Vork ..... 239/119
3,637,142 A * 1/1972 Gassaway ..... 239/394
4,116,386 A * 9/1978 Calder ..... 239/119
5,255,848 A * 10/1993 Rhodehouse ..... 239/119
5,704,548 A * 1/1998 Hedger et al. ..... 239/119
2003/0010838 A1 * 1/2003 Earl ..... 239/104

FOREIGN PATENT DOCUMENTS

JP 04190865 A * 7/1992 ..... B05B/12/08
JP 05277406 A * 10/1993 ..... B05B/15/02

* cited by examiner

*Primary Examiner*—David A. Scherbel
*Assistant Examiner*—James S. Hogan
(74) *Attorney, Agent, or Firm*—Ostrolenk, Faber, Gerb & Soffen, LLP

(57) ABSTRACT

Reversible spray head, including a reversible element or key (5) placed in a central body and through which is a channel (9) with a spray insert (10, 11) on each end; rotating the element or key 180° allows changing from one spray hole to the other.

22 Claims, 6 Drawing Sheets

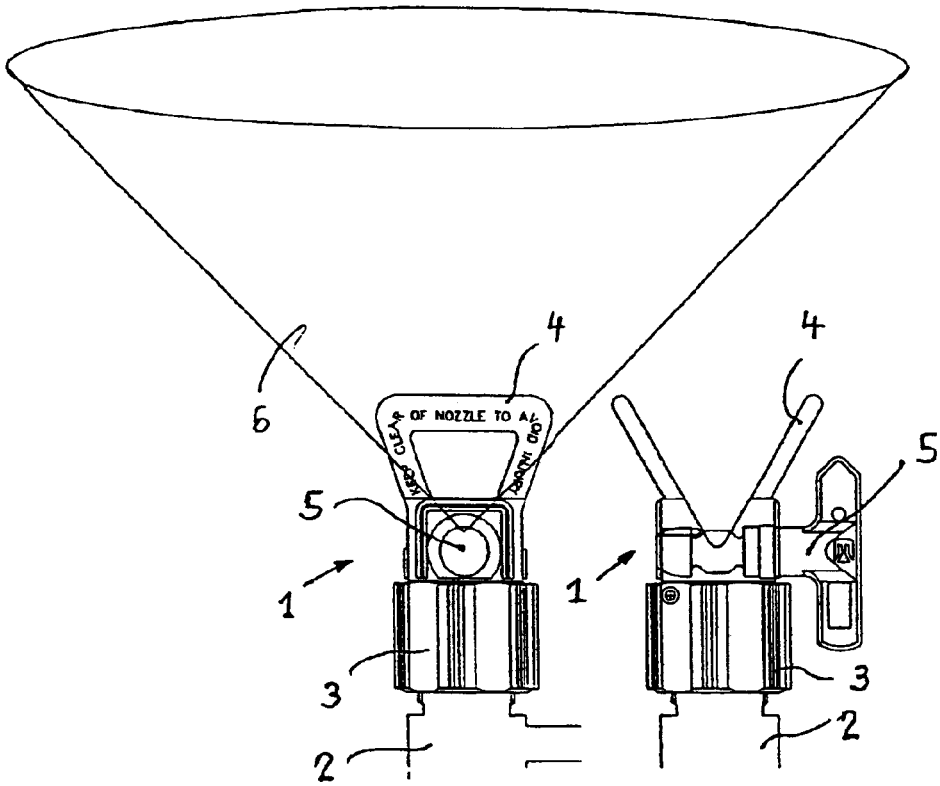
Fig. 1
Fig. 2
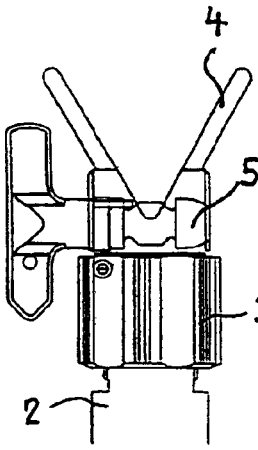
Fig. 3
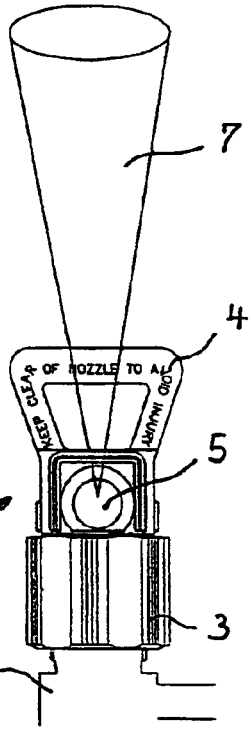
Fig. 4

REVERSIBLE SPRAY HEAD

FIELD OF THE INVENTION

The invention consists of a reversible spray head, for a spray gun in particular.

BACKGROUND OF THE INVENTION

The holder benefits from several patents for high-pressure spray heads or nozzles including a rotating element in the form of a key placed in a central body. Through the key, there is a channel with a spray hole and a watertight joint between the rotating element and the gun. The central part of the rotating element is spherically shaped so it can work with the joint inside the central body, and the channel with the spray hole at the end passes through this central part.

These spray heads are described in particular in the European patents No 1192011 and No (D98906788.9). These nozzles offer the advantage of being reversible, in other words the rotating element in the form of a key is in a given position, ready to operate for spraying, and if you turn the key 180°, the reversal of the flow of liquid then allows you to clean the nozzle and the pipe if it is blocked. Nozzles that are called reversible are therefore particularly interesting, because if you have to clean them, the operation is very simple and is carried out by simply turning the rotating element 180°. The reversal of flow generally allows you to unblock the pipe and rotating the key again by 180° puts the head back in the working position.

However, if you want to modify the spray angle or flow of the spray hole, you then have to unscrew the head of the gun, take out the key, and put in another key with a nozzle allowing a wider or narrower angle of spray.

SUMMARY OF THE INVENTION

The arm of the invention is to try to eliminate this operation at least partially, and have two nozzles with different spray angles available on one reversible spray head.

The reversible spray head, for spray guns in particular, including a reversible element placed in a central body and through which there is a channel with a spray hole at one end and a watertight joint between the rotating element and the gun onto which the central body is fixed, is characterised by the fact that the channel of the reversal element has a spray hole at each end.

Thus, one will simply have to mount a spray nozzle with a different spray angle on each end of the channel of the reversible element in order to have the possibility of changing nozzle and therefore changing the width of spray by a simple operation consisting of turning the key 180°. This measure means that one can save considerable time and have a wide spray angle and a smaller spray angle on the same key, changing from one to the other being achieved by simply rotating the key.

The fact that two spray nozzles are attached opposite each other to each end of the channel through the reversible element does not prevent the cleaning operation that could be carried out on the previous design of heads by turning the rotating element 180°. This is still possible in the head invented and if one of the nozzles gets blocked, it is still possible to turn the key 180° to carry out the unblocking operation as was done with the previous design of heads.

Finally, the fact that there are two opposite spray holes placed at each end of the channel means that one can achieve an excellent atomisation of the sprayed product greatly superior to what was obtained in the previous design of heads. The operation of the reversible spray head according to the invention is therefore perfectly satisfactory and, during tests, a very high performance spray was observed.

In a preferred method of construction, the spray holes placed at each end of the channel include two spray inserts placed opposite each other, with a watertight joint between the two inserts, the unit formed by the two opposite inserts and the joint butting up against a stop at one end of the channel, on the one hand, and placed under tension by a shrink ring screwed at the other end of the channel, on the other.

The two inserts can be aligned with each other by means of an internal metal tube.

The inserts forming the spray holes are made of tungsten carbide and are cut in a V-shape, so as to obtain different angles of spray and different flows.

The joint placed between the two opposite inserts can be made out of PTFT Teflon or polyamide (nylon).

The inserts are cut so that one end of the channel has a spray angle of 30 to 120°, while at the other end of the channel, the angle of spray will range from 5 to 25°.

According to one method of construction, the reversible element in which the channel containing the two spray holes is placed is a cylindrical shaped key passing through the central body of the spray head. By rotating the key 180°, it is possible to change from one spray hole to the other.

According to another method of construction, the reversible element in which the channel containing the two spray holes is placed is a key with a sphere in the center inserted into the central body of the head, the channel passing through the middle of the sphere. By rotating the key 180°, it is possible to change from one spray hole to the other.

According to another method of construction, the reversible element includes a support component that is conical at the front, into which an internal component that is also conical at the back is screwed. The angle of the cones of the front and back parts of the element is the same and the two components enclose a unit formed of two opposite inserts separated by a joint. In this last method, the two inserts can be aligned with each other by means of an internal metal tube and two components with a tapered front and back part can be made out of metal and screw-glued into each other. The tapered reversible components are intended to be used in the guns found on the market and in which the head can be simply unscrewed from the gun, the reversible component is turned round and everything is screwed back together.

According to a final method of construction, the top part of the head has two projections on the edge of the head and face to face on top of the upper surface of the head. The projections have oblong holes in them making it possible to direct a supply of additional flow coming from the gun by means of channels through the head, the oblong holes being arranged to atomise the main high pressure jet coming from the central nozzle of the insert. The oblong holes are arranged to direct the additional air onto the ball which protrudes two to five millimetres from the upper surface of the head. The top part of the head also has four air additional air nozzles placed on either side of the main oblong hole of the insert, the nozzles being linked to additional air supply channels, themselves linked to an annular chamber supplied with air by the gun in such a way that a pressure variation of the air coming out of the nozzles makes it possible to strike the main high pressure beam coming out of the insert and close the said beam according to the increase in pressure of the additional air coming from the gun.

The nozzles and channels can be arranged in such a way as to make it possible to change the beam coming from the insert (10) from an angle of 90 to 120° to an angle of 30°.

The nozzles can be arranged in such as way as to make it possible to change the beam coming from the insert from an angle of 25° to an angle of 5°.

By way of examples, the plans represent several methods for the reversible spray head invented.

BRIEF DESCRIPTION OF THE DRAWINGS

FIG. 1 is a side view of an "airless" spray head mounted on a gun and represented schematically, FIG. 2 is a frontal view of the spray head in FIG. 1 showing the key in its wide angle spray position as per FIG. 1, FIG. 3 is a frontal view of the spray head in FIGS. 1 and 2, the key being reversed 180° in relation to its position in FIG. 2, in order to present a smaller angle of spray, FIG. 4 is a side view of the spray head in FIG. 3 showing the angle of spray corresponding to the position of the key in FIG. 3.

DETAILED DESCRIPTION OF THE PREFERRED EMBODIMENTS OF THE INVENTION

Figure 5:
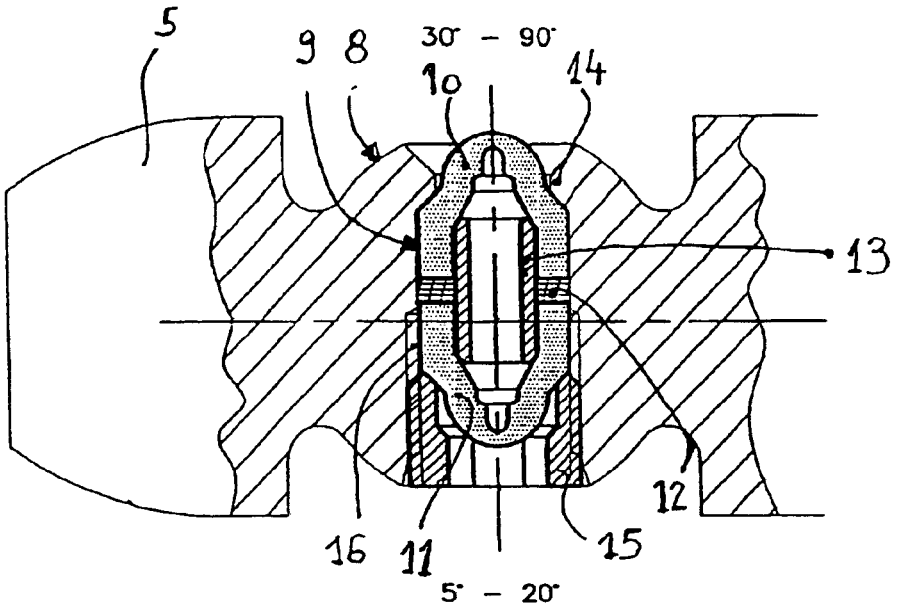
FIG. 5 is a partial longitudinal section through the key of the spray head in FIGS. 1 to 4, the channel of the reversible key having two spray inserts mounted opposite each other.

The method of construction represented in FIGS. 1 to 6 includes a high pressure "airless" spray head 1 mounted on a gun schematically represented in 2. The head 1 is attached to the gun by means of a locking screw 3. As with all spray heads, the head 1 has a safety guard 4 intended to protect the user of the gun. In the spray head 1, there is a reversible key 5 which, as represented in FIGS. 2 and 3, is likely to turn in the head in such a way as to occupy positions 180° apart. FIGS. 1 and 2 show the key 5 in the position indicated in FIG. 2, and FIGS. 3 and 4 with the key 5 turned 180° compared to the position in FIGS. 1 and 2. When the key 5 is represented in the position in FIG. 2, this position corresponds to a spray jet 6 of a wide angle as represented in FIG. 1. When the key 5 is turned 180°, it ends up in the position represented in FIG. 4, and the spray hole then allows a jet 7 forming a small angle. It will be explained below how the spray holes are mounted in the key in such a way as to allow different spray flows, and change from a very open angle corresponding to an angle of approximately 90° as represented in FIG. 1 of the drawings, to a much smaller angle of approximately 20°, as represented in FIG. 4 of the drawings.

FIG. 5 represents a section through the key 5 in FIGS. 1 to 4. We see in FIG. 5 that the reversible key or element 5 has a spherical part 8 in the middle through which a channel 9 passes from one side to the other. In the channel 9, there are two spray inserts 10 and 11 placed opposite each other, a joint 12 being positioned between the two inserts.

The two inserts 10 and 11 placed opposite each other are aligned in relation to each other by means of a stainless steel tube 13 placed inside the unit formed by the two inserts 10 and 11. The top of the unit formed by the two inserts 10 and 11 inserted into the channel 9 buts up against a constriction 14 of the channel and at the bottom part of the channel, the unit formed by the two inserts is pressed against the constriction 14 by means of a shrink ring 15 screwed into the threaded bottom part 16 of the channel 9.

The inserts 10 and 11 are classic inserts made out of tungsten carbide and cut in a V shape in order to obtain different angles and different flows of spray. As represented in the drawing in FIG. 5, the insert 10 will be an insert allowing a spray flow with a big angle ranging from 30 to 90° and the insert 11 will be cut in a V shape in order to obtain a smaller spray angle ranging from 5 to 20°.

The fact that the two inserts 10 and 11 are placed opposite each other in the channel 9 through the spherical part 8 of the key 5 explains how you can change from one spray to another by a 180° rotation of the key 5, as represented schematically in FIGS. 1 to 4. Furthermore, the unit formed by the two inserts placed opposite each other makes it possible to obtain an excellent homogenisation of the fluid when it passes through the two inserts. The quality of the spray jet is thus improved compared to spray heads where there is only one single insert. Finally, the advantage of being able to change from a wide jet to a thinner jet is a considerable advantage for the user who is not therefore obliged to change the key 5 or the head during the operation.

The spray head with a reversible key similar to the one described in FIGS. 1 to 5 can be advantageously used in the painting of boats, cars, aeroplanes etc, where the surfaces have stiffeners or ribs. So, for spraying large surfaces, the user can use the wide angle, and for the stiffeners or ribs, he can change to the small angle of spray by simply turning the key. The professional can immediately see the many applications permitted by a head with a reversible element or key 5 as per the invention. These applications consist of all applications where paint or treatment products are applied: for joinery, carpentry, doorframes, etc. Such a head can also be used for the spraying of mastic in the automobile industry. As mentioned above, the professional can easily understand the enormous advantage offered by a spray head with a reversible element similar to the one that has just been described, where the spray jet can be chosen according to the size of the surface to be sprayed, by simply turning a key, without changing the key or the head.

In the method of construction shown in FIGS. 1 to 5, the spray head, the reversible element or key and all of the constituent parts with the exception of the inserts can be made out of ferrous or non-ferrous metal. As for the inserts, they would be better made out of tungsten carbide, and the joints in PTFE Teflon or polyamide (nylon). Alternatively, the head and the constituent parts can also be made out of plastic.

Figure 6:
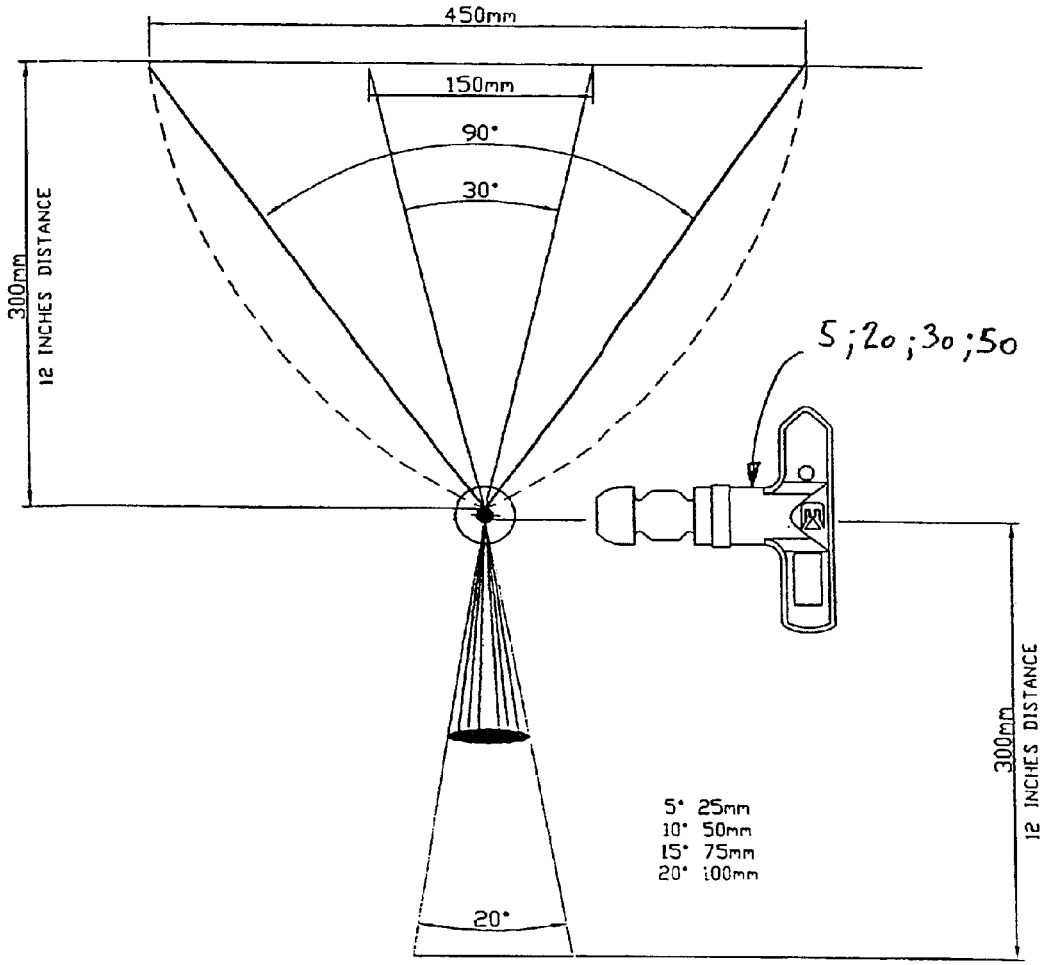
FIG. 6 is a schematic view of the spray angles and jet widths obtained with the head represented in FIGS. 1 to 5.

The diagram in FIG. 6 represents the angles of spray flows that can be chosen for both of the two spray nozzles placed on the reversible element or key 5. In the top part of FIG. 6, above the key 5, you can see that spray holes can be chosen for spray angles ranging from 30 to 90°.

Over a distance of 300 mm, the professional can easily understand that a 30° opening angle of spray flow corresponds to a 150 mm sweeping band, and with a 90° opening angle, one can achieve a 450 mm spray band. It is obvious, furthermore, that spray holes can be made for other angles between 30 and 90°. It is even possible to widen the spray beam up to 110–120°.

In the bottom part of FIG. 6, below the key 5, the spray angles and distances are shown for a spray hole with an opening angle of 5°, 10°, 15° and 20°. For these angles of opening, the spray band widths at a distance of 300 mm correspond to 25 mm for 5°, 50 mm for 10°, 75 mm for 15° and 100 mm for 20°. By mounting two spray nozzles on the same reversible element 5, one can therefore choose opening angles ranging from 5 to 120°. All combinations are possible. For a given key, the user will therefore be able to choose a wide angle and a small angle of spray according to the work he is intending to carry out.

Figure 7:
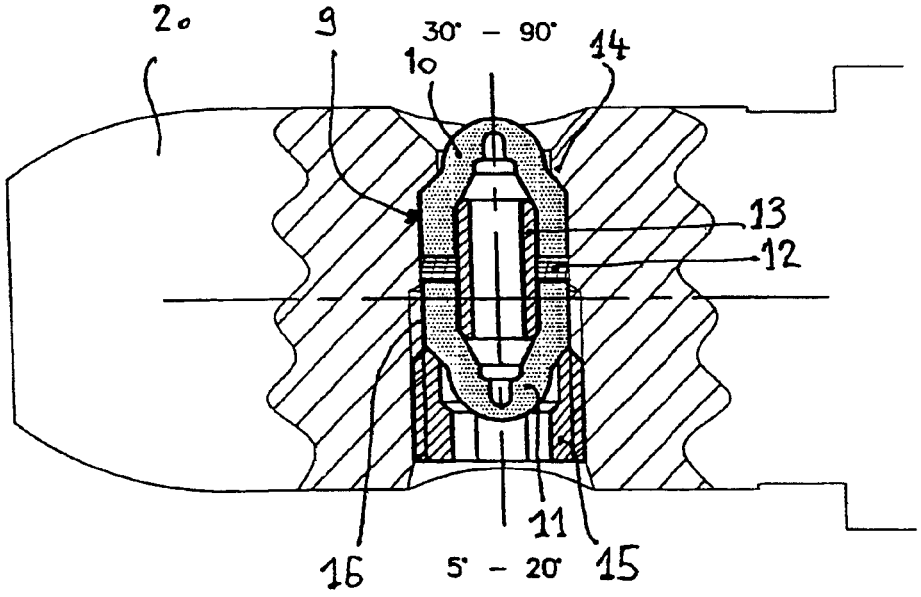
FIG. 7 represents a method of construction with a cylindrical reversible key with two spray inserts mounted opposite each other and intended to be mounted in a similar head to that of FIGS. 1 to 4.

In the method of construction in FIG. 7, the reversible element or key 20 is a cylindrical element inserted into a head provided for this purpose. Apart from the fact that the reversible element or key is cylindrical, all of the components of this element 20 are the same as those described for FIG. 5. The method of construction shown in FIG. 7 also has the channel 9 through the key 20, inserts 10 and 11 kept aligned by tube 13, the unit formed by the inserts and the joint 12 being held tight against an annular constriction 14 at the top of the channel by a ring 15 screwed into a threaded part 16 at the bottom of the channel. The two inserts 10 and 11 forming a spray unit with joint 12 will have the same opening angles as the previous method, in other words a nozzle at the top with a spray opening of 30 to 90° and at the bottom a nozzle with a spray angle of 5 to 20°. It's obvious that the unit thus formed and offering different spray angles will have the same flow for both uses. So, the user has to take account of this fact and have a greater sweeping speed when he uses the small nozzle.

Figure 8:
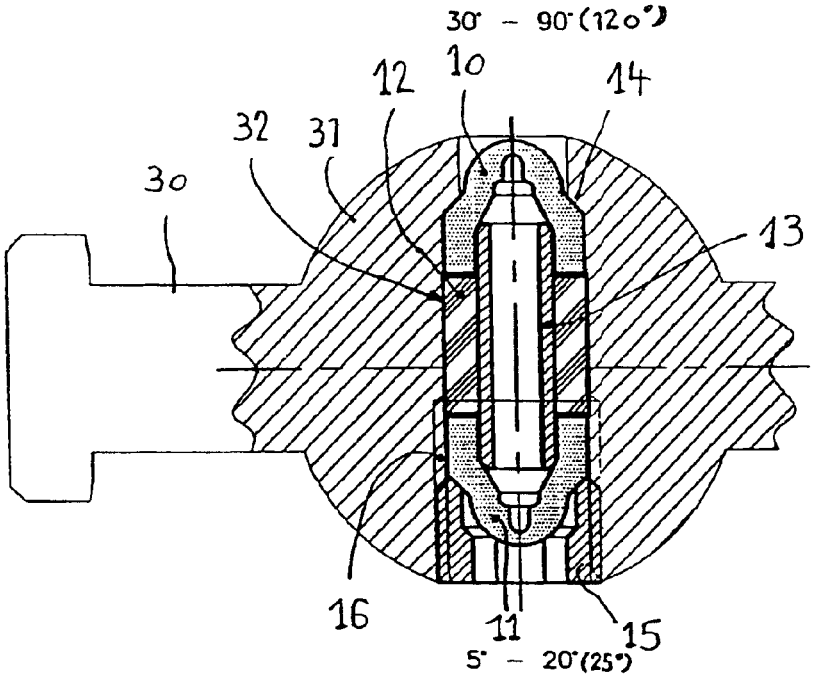
FIG. 8 represents a variant of the head in FIG. 5 with a reversible key with a spherical central part through which there is a channel in which two inserts are mounted opposite each other. The method of construction in FIG. 8 was developed by the holder and corresponds to the European patent no 1192011.

The method of construction in FIG. 8 shows the reversible element or key 30 of a spray head called TRI-A, developed by the holder in 1999 and represented in FIG. 10 to 13. This spray head, which is particularly effective, is the subject of the European patent no 1 192 011. The head described in the European patent is particularly effective and offers the possibility of modulating the jet with additional air. This head becomes even more effective if it is fitted with the reversible element or key with two spray holes. In this case, a spray hole with an angle of 90 to 120° and a second with an angle of 5 to 20° will be mounted opposite each other. Thus, with the use of additional air, one will be able to obtain an adjustable spray jet ranging from 5 to 120°. As represented in FIG. 8, the reversible element or key 30 includes a sphere 31 in the center through which there is a channel 32. As in the previous methods of construction, two inserts 10 and 11, held tight by a joint 12, and aligned by a metal tube 13, are inserted into the channel 32. The unit thus formed butts up at the top of the sphere 31 against an annular constriction 14, the unit being kept in place by a ring 15 screwed into a threaded bore 16 created at the bottom of the channel 19. As already mentioned previously, and although FIG. 8 represents inserts offering opening angles ranging from 30 to 90° and 5 to 20° respectively, one can choose an insert of 90° or more at the top, and an insert offering an opening angle of 20° at the bottom. The use of the additional air available in the TRI-A heads will allow one to choose any spray angle between 5° and 120°.

Figure 9:
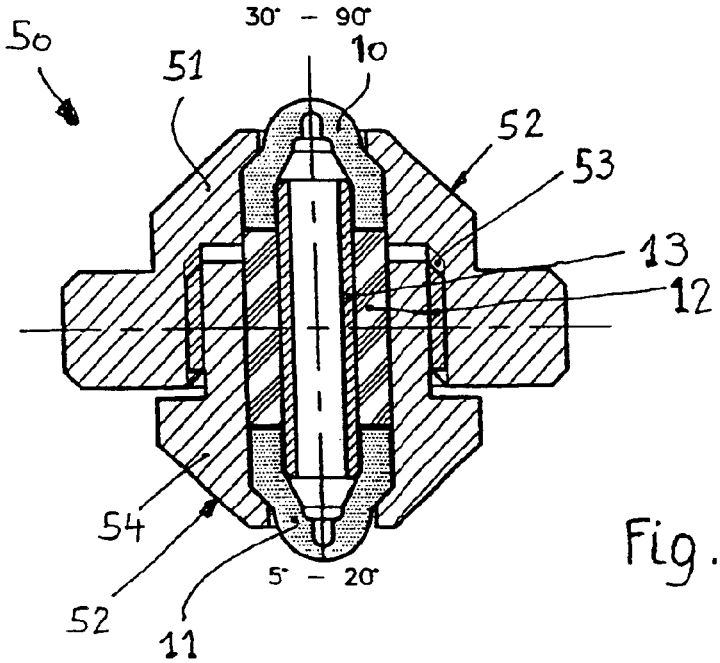
FIG. 9 presents a conical reversible element placed at the end of a spray gun making it possible to reverse the position of the element.
Figure 10:
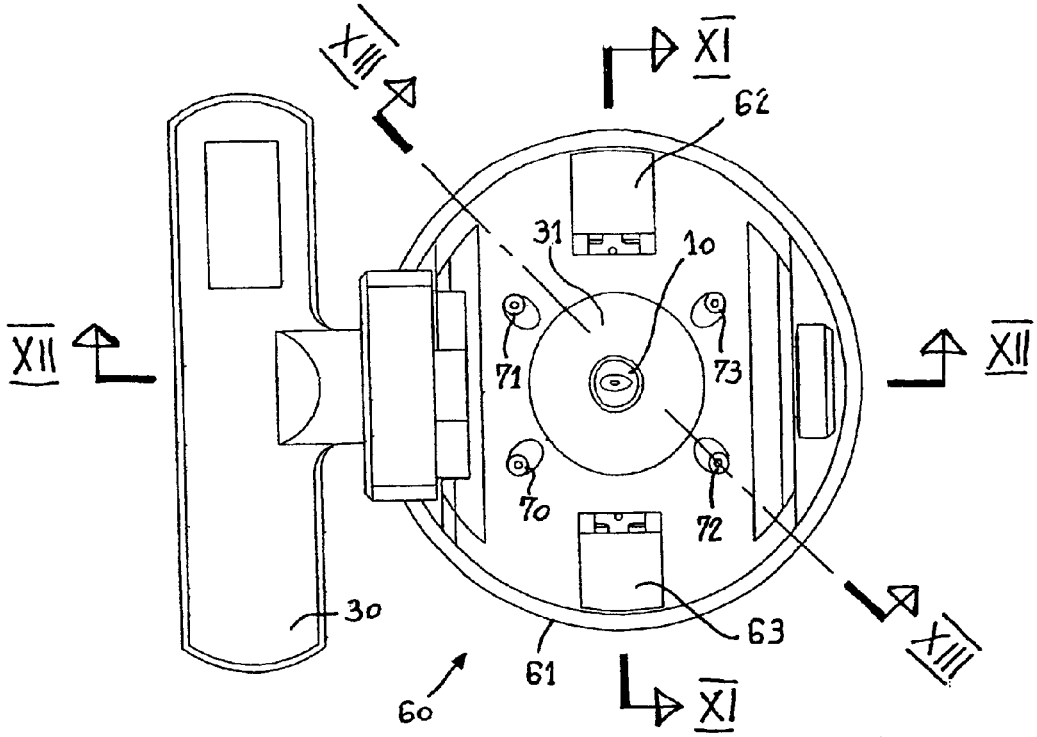
FIG. 10 is a top view of a method of construction of a spray head for a high pressure gun with a reversible key similar to the one in FIG. 8, the head having a series of additional holes allowing the supply of a low pressure air flow on the fluid beam coming out of the nozzle.
Figure 11:
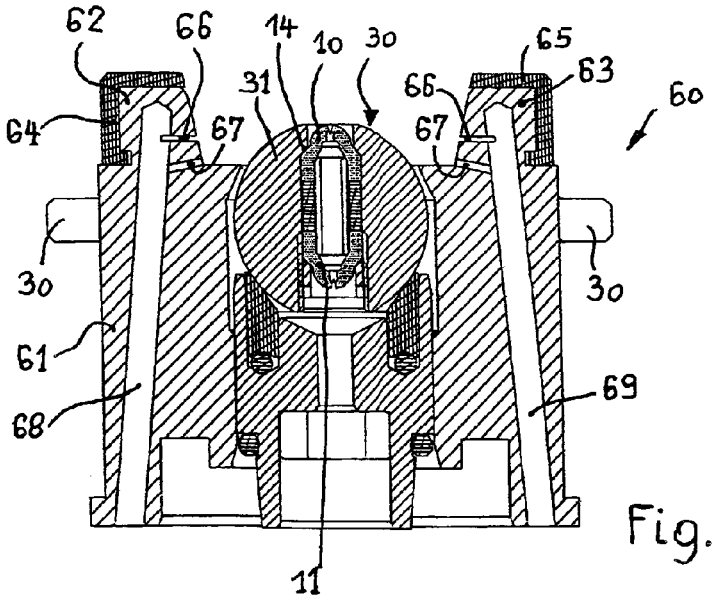
FIG. 11 is a section through the head in FIG. 10 along the line XI—XI.
Figure 12:
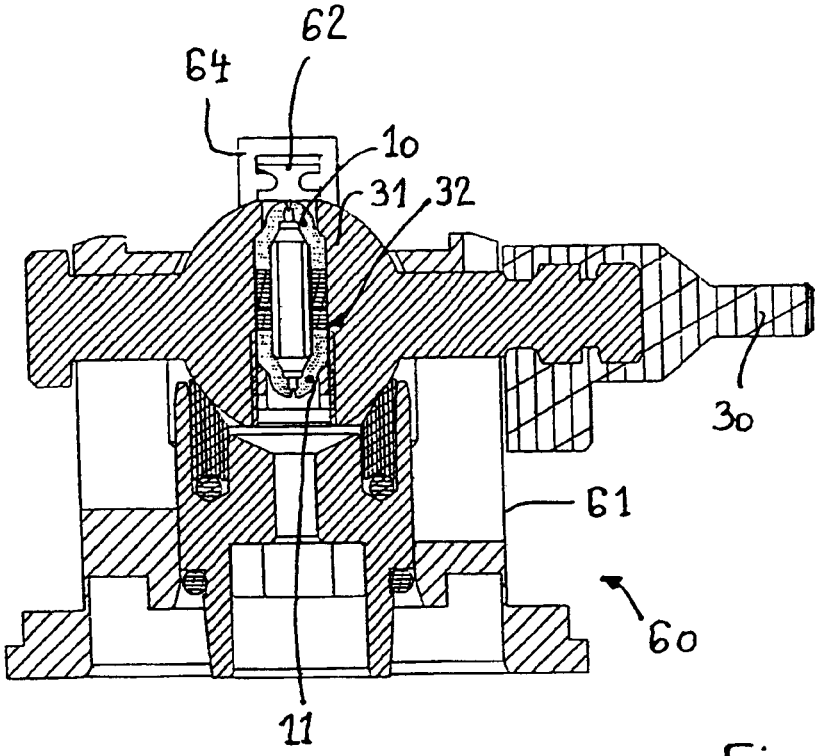
FIG. 12 is a section through the head in FIG. 10 along the line XII—XII.
Figure 13:
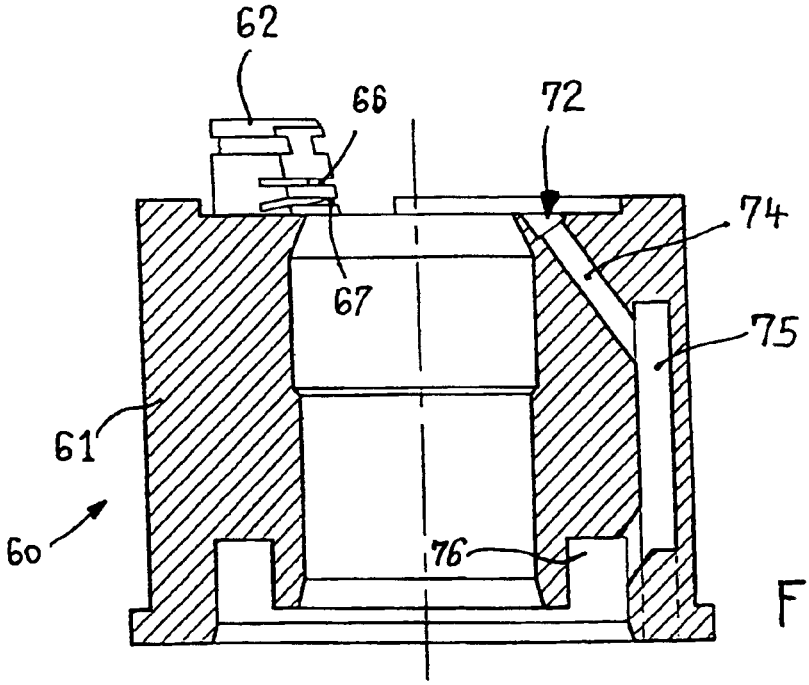
FIG. 13 is a section through the head in FIG. 10 along the line XIII—XIII.

The method of construction presented in FIG. 9 shows a reversible element 50 usually used in a gun not represented which has a circular ring at the front allowing one to turn the element 50 on the gun.

This ring is intended to grip the element 50, which can thus be easily turned around 180° if one unscrews the front ring on the gun. In previous designs, this element 50 or component 50 was usually fitted with a single nozzle at one end, and its reversible function was intended to allow one to unblock the nozzle by turning the component 180° when the duct was blocked. It was then sufficient to simply unscrew the front part of the gun, turn the component 50 and screw back the ring of the gun to unblock the component or return it to its spray function. So the reversible element or component 50 has a ring-shaped top part 51, with a conical surface 52 on the top. Inside component 51, there is a bore 53 with a threaded part into which a bottom part 54 is screwed which also has a conical surface 52 identical to that of part 51. As represented in the drawing, the two components 51 and 54 enclose, in the method of construction shown in FIG. 9, the two inserts 10 and 11 opposite each other aligned by means of the tube 13, and rendered watertight by means of joint 12. The unit formed by the inserts 10 and 11 is held tight between the two components 51 and 54, the connection between the two components being a "screw-glued" connection. In this method of construction, one will choose an insert 10 with an angle chosen between 30 and 120°, the insert 11 with an angle chosen between 5 and 25°. The user of the design in FIG. 9 will then be able to change the spray angle by simply turning the component 50 after unscrewing the front part of the gun holding this component 50 tight. Since the conical surfaces 52 of the components 51 and 54 are identical, the component 50 is perfectly watertight in the gun.

The two components forming the reversible element 50 can be made out of stainless steel, brass or aluminium, and also ferrous and non-ferrous metals. As for the inserts, they will preferably be made out of tungsten carbide and cut with the oblong hole corresponding to the desired angle of spray.

As represented in FIG. 9, the professional can see that the invention is not limited to a rotating key, and that the principle of a unit consisting of two inserts or two spray holes mounted opposite each other can be applied to all systems of guns with a reversible spray component. So, the invention consists of the concept of placing a unit in a reversible element of a spray head in which two spray holes are placed opposite each other. The spray holes will be cut in such a way as to offer two different spray flow options when the reversible element is turned. The spray heads equipped with a reversible key, as represented in FIG. 1 to 8, obviously represent an ideal application of the invention, it being understood that one can change nozzle by simply turning the key 180°.

The method of construction shown in FIGS. 10 to 13 represents a spray head called TRI-A intended to take the key described in FIG. 8. The spray head 60 represented in FIGS. 10 to 13 includes a central body 61 through which the key 30 in FIG. 8 passes. As already described, key 30 has a sphere 31 in the center through which a channel 32 passes in which inserts 10 and 11 are mounted opposite each other. The head 60 will not be described in detail, it being understood that it is the subject of the European patent no 1.193 011. However, the options of the supply of additional air will be described to show the different spray angles that can be obtained. Thus, the head 60 has two projections 62 and 63 on the top covered by caps 64 and 65. The projections 62 and 63 extend beyond the top of the head 60, and are used to supply the additional air that strikes the ball 31 and will thus make it possible to atomise the jet coming out of the nozzle of insert 10. The projections 62 and 63 have two grooves 66 and 67 connected with supply channels 68 and 69, which will be in contact with a supply of low pressure air controlled by the gun on which the head 60 is mounted. As shown in FIG. 2, the additional air comes out of the oblong holes 66 and 67 so as to strike the ball 31. The high pressure jet coming out of insert 10 is then disrupted, and the product forming the jet is thus atomised. The oblong holes 66 in the projections 62 and 63 are horizontal and the oblong holes 67 form an angle of 12°. This 12° angle can vary by 5° up or down and thus be between 7° and 17°.

The top part of the spray head 61 also has four additional air nozzles 70, 71, 72 and 73 placed on either side of the main oblong hole of insert 10. The four nozzles 70 to 73 are connected to air supply channels 74 and 75 in turn connected with an annular supply chamber 76 connected to an air supply provided by the gun.

The supply channels 74 form an angle of approximately 55° with the horizontal and are arranged around the head 60, so that the air coming out of the nozzles 70, 71, 72 and 73 directly strikes the main jet of material coming out of the nozzle of the insert 10 or the insert 11 if the key 30 has been rotated 180°. The variation of the additional air coming from the gun therefore makes it possible to close the main beam of the oblong hole of the insert 10 or 11 by varying degrees. Thus, if for example the angle of the spray beam coming from the insert 10 is 90° without additional air, as represented in FIG. 6, the said beam can be closed gradually up to 30° by varying the additional air pressure coming from the gun. The same effect can be obtained on the nozzle of insert 11 the maximum opening angle of which is 20° and which can be reduced to 5° minimum.

The head 60 that has just been described therefore allows one to adapt the high pressure beam coming from the inserts 10 and 11 to all situations, the insert 11 from 20 or 25° and the insert 10 from 90°, even 120°.

I claim:

1. A spray head for a spray gun, the spray head comprising:

a central body fixed to the spray gun;

a reversible element placed in the central body, the reversible element comprising a channel with a spray hole at each end of the channel;

a shrink ring placed at one end of the channel;

two spray inserts, each of the two spray inserts placed in the channel and opposite to each other and;

a fluid-tight joint placed between the two inserts, wherein one of the inserts abuts a stop located at one end of the channel and the other insert abuts the shrink ring, and the inserts are placed under tension by the shrink ring.

2. The spray head according to claim 1, wherein when the reversible element is in a first position, a first spray pattern is produced and when the reversible element is in a second position, a second spray pattern is produced.

3. The spray head according to claim 1, wherein the two opposite spray inserts are aligned with each other by internal metal tube.

4. The spray head according to claim 1, wherein the spray inserts are made from tungsten carbide and are V-shaped, so as to obtain different spray angles.

5. The spray head according to claim 1, wherein the fluid-tight joint is made of PTFE Teflon or polyamide.

6. The spray head according to claim 1, wherein the spray holes or the inserts are cut in such a way as to have a spray angle of 30 to 120° at one end of the channel, and to have a spray angle of 5 to 25° at the other end of the channel.

7. The spray head according to claim 1, wherein the reversible element is a cylindrical shaped key passing through the central body, and wherein a 180° rotation of the key switches from one spray hole to the other.

8. The spray head according to claim 1, wherein the reversible element is a key which has a sphere in the center inserted into the central body, and the channel passes through the sphere, wherein a 180° rotation of the key switches from one spray hole to the other.

9. The spray head according to claim 1, wherein the reversible element further comprises:

a support component having a conical-shaped front part into which an internal component having a conical-shaped back part is screwed, wherein the angle of the cones of the front and back parts of the element are the same, and wherein the two parts form a unit by the two opposite inserts separated by the fluid-tight joint.

10. The spray head according to claim 9, wherein the two inserts are aligned with each other by an internal metal tube.

11. The spray head according to claim 9, wherein the two components are made out of metal and screwglued one inside the other.

12. The spray head according to claim 1, further comprising two projections located on an outer edge of the spray head and positioned face to face on top of an upper surface of the head, wherein the projections having oblong holes such that a supply of additional air coming from the gun through channels passing through the head can be directed, and further wherein the oblong holes are arranged to atomize a main high pressure jet coming from a central nozzle of the insert.

13. The spray head according to claim 8, wherein the oblong holes are arranged to direct conditioned air onto a ball which protrudes two to five millimeters from an upper surface of the spray head.

14. The spray head according to claim 1, wherein a top part portion of the spray head has four additional air nozzles placed either side of a main oblong hole of the insert, the nozzles being connected to channels supplying additional air in turn connected to an annular chamber supplied with air by the spray gun such that a pressure variation of the air coming out of the nozzles makes it possible to strike a main high pressure beam coming out of the insert, and close the beam according to the increase in pressure of the additional air coming out of the spray gun.

15. The spray head according to claim 14, wherein the nozzles and the channels are arranged in such a way as to allow one to change the beam coming from the insert from an angle in the range of 90° to 120° to an angle in the range of up to 30°.

16. The Spray head according to claim 14, wherein the nozzles and channels are arranged in such a way as to make it possible to change the beam coming from the insert from an angle of 25° to an angle of 5°.

17. The spray head according to claim 1, wherein the spray holes or the inserts are cut in such a way as to have a spray angle of 30 to 120° at one end of the channel, while at the other end of the channel the spray angle will be from 5 to 25°.

18. The spray head according to claim 1, wherein the reversible element is a cylindrical shaped key passing through the central body of the spray head, wherein a 180° rotation of the key switches from one spray hole to the other.

19. The spray head according to claim 1, wherein the reversible element is a key which has a sphere in the center inserted into the central body, the channel passing through the middle of the sphere, wherein a 180° rotation of the key switches from one spray hole to the other.

20. The spray head according to claim 1, wherein the reversible element includes a support component with a conical front part, into which an internal component is screwed with a back part also conical, the angle of the cones of the front and rear parts of the element being the same, the two parts enclosing a unit formed by two opposite inserts separated by a joint.

21. The spray head according to claim 12, wherein the oblong holes are arranged to direct conditioned air onto the ball which protrudes two to five millimeters from the upper surface of the head.

22. The spray head according to claim 1, wherein a top portion of the head has four additional air nozzles placed either side of the main oblong hole of the insert, the nozzles being connected to channels supplying additional air in turn connected to a annular chamber supplied with air by the gun in such a way that a pressure variation of the air coming out of the nozzles makes it possible to strike the main high pressure beam coming out of the insert, and close the said beam according to the increase in pressure of the additional air coming out of the gun.

* * * * *